US011643730B2

(12) United States Patent
Marya et al.

(10) Patent No.: US 11,643,730 B2
(45) Date of Patent: May 9, 2023

(54) ANTI-SCALE DEPOSITION HIERARCHICAL COATINGS FOR WELLBORE APPLICATIONS

(71) Applicant: Schlumberger Technology Corporation, Sugar Land, TX (US)

(72) Inventors: Manuel Marya, Sugar Land, TX (US); Virendra Singh, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/456,634

(22) Filed: Jun. 28, 2019

(65) Prior Publication Data

US 2020/0407852 A1 Dec. 31, 2020

(51) Int. Cl.

| | |
|---|---|
| ***C23C 18/16*** | (2006.01) |
| ***C23C 18/31*** | (2006.01) |
| ***C23C 18/18*** | (2006.01) |
| ***C25D 5/36*** | (2006.01) |
| ***C25D 5/38*** | (2006.01) |

(Continued)

(52) U.S. Cl.

CPC ..... *C23C 18/165* (2013.01); *C23C 18/1637* (2013.01); *C23C 18/1824* (2013.01); *C23C 18/31* (2013.01); *C23C 28/321* (2013.01); *C23C 28/322* (2013.01); *C23C 28/3455* (2013.01); *C23C 28/44* (2013.01); *C25D 3/04* (2013.01); *C25D 3/12* (2013.01); *C25D 5/10* (2013.01); *C25D 5/36* (2013.01); *C25D 5/38* (2013.01); *C25D 9/02* (2013.01); *C25D 9/04* (2013.01); *E21B 34/06* (2013.01); *E21B 43/123* (2013.01)

(58) Field of Classification Search

None

See application file for complete search history.

(56) References Cited

U.S. PATENT DOCUMENTS

| | | | |
|---|---|---|---|
| 8,628,836 | B2 | 1/2014 | Lynch |
| 9,534,476 | B2 | 1/2017 | Kumar et al. |

(Continued)

FOREIGN PATENT DOCUMENTS

| | | | |
|---|---|---|---|
| JP | 2017512902 | A | 5/2017 |
| WO | 9953170 | A1 | 10/1999 |
| WO | WO2013016641 | A2 | 1/2013 |

OTHER PUBLICATIONS

International Search Report and Written Opinion issued in International Patent application PCT/2020/039863 dated Oct. 15, 2020 (12 pages).

(Continued)

*Primary Examiner* — Seth Dumbris
*Assistant Examiner* — Kim S. Horger

(57) ABSTRACT

The disclosure provides for anti-scale deposition coatings for use on surface, such as on oilfield parts. The coating includes a first, sublayer of a metal, ceramic, or metal-ceramic composite, which is characterized in having a hardness in excess of 35 HRC. The coating includes a second, top layer over the first layer, that is a polymer. A surface of the first layer may be conditioned to have a roughened or patterned topology for receipt of and adherence with the at least one top layer. The first layer may provide the coating with hardness, and the at least one top layer may provide the coating with low-friction and anti-scale properties.

13 Claims, 6 Drawing Sheets

(51) Int. Cl.

| | |
|---|---|
| ***C25D 9/02*** | (2006.01) |
| ***C25D 5/10*** | (2006.01) |
| ***C25D 3/04*** | (2006.01) |
| ***C25D 3/12*** | (2006.01) |
| ***C25D 9/04*** | (2006.01) |
| ***C23C 28/00*** | (2006.01) |
| *E21B 43/12* | (2006.01) |
| *E21B 34/06* | (2006.01) |

(56) References Cited

U.S. PATENT DOCUMENTS

| | | | | |
|---|---|---|---|---|
| 2009/0011252 | A1* | 1/2009 | Stein | C23C 16/0272 428/446 |
| 2011/0048809 | A1* | 3/2011 | Duckworth | C10M 105/72 508/136 |
| 2011/0174548 | A1* | 7/2011 | Patel | B23P 6/00 175/425 |
| 2011/0220348 | A1* | 9/2011 | Jin | E21B 17/1085 166/244.1 |
| 2015/0147523 | A1 | 5/2015 | Kumar et al. | |
| 2015/0240146 | A1* | 8/2015 | Sista | E21B 17/00 428/141 |

OTHER PUBLICATIONS

Baytekin-Gerngross et al., Making metal surfaces strong, resistant, and multifunctional by nanoscale sculpturing, Nanoscale Horiz., 2016, 1, pp. 467-472.

Golovin et al., Bioinspired surfaces for turbulent drag reduction, Philosophical Transactions A, Dec. 2017, 20 pages.

Kota et al., The design and Applications of superomniphobic surfaces, NPG Asia Materials 2014, 6 e109, Nature Publishing Group, 16 pages.

Kumar et al., Reduction in Scale Build-up from Sub-surface Safety Valve Using Hydrophobic Material Coating, SPE 166218, SPE Annual Technical Conference and Exhibition held in New Orieans, Louisiana, USA, Sep. 30-Oct. 2, 2013, 15 pages.

Latthe et al., Mechanically bendable superhydrophobic steel surface with self-cleaning and corrosion-resistant properties, Journal of Materials Chemistry, vol. 3, Issue 27, Jul. 21, 2015, pp. 14263-14271.

Wang et al., Mechanically Robust Superhydrophobic Steel Surface with Anti-icing, UV-Durability, and Corrosion Resistance Properties, American Chemical Society, Applied Materials and Interfaces, vol. 7, Issue 11, Mar. 25, 2015, pp. 6260-6272.

Lightmotif, Laser Surface Texturing, Enschede, Netherlands, 2018, https://www.lightmotif.nl/texturing/.

* cited by examiner

ANTI-SCALE DEPOSITION HIERARCHICAL COATINGS FOR WELLBORE APPLICATIONS

FIELD

The present disclosure relates to anti-scale coatings for use in wellbore applications, to apparatus and systems including the same, and to methods of making and using the same.

BACKGROUND

During oil and gas drilling applications, scale may form as a deposit or coating on a surface of metal components, rock or other materials. Scale occurs in both production and injection wells. Such scale deposits may occur, for example, as a result of the precipitation of a reaction product of a chemical reaction between the surface and a component within wellbore fluid. Scale (i.e., mineral salt deposits) may, thus, occur on the surface of downhole tools and components, such as on the surface of wellbore tubulars and components. Such scale deposits can affect downhole tool or component performance. For example, scale can restrict or plug flow paths or orifices within production tubulars.

Prior efforts to reduce or eliminate scale have included the use of scale inhibitors to inhibit the formation of scale, as well as scale removal after the scale has formed. Scale removal can involve the mechanical removal of the scale or chemical removal of the scale.

Some coatings are too soft for suitability in use in harsh downhole environments and operating conditions and will, thus, suffer from one or more failures, such as bubbling (porosity) scratches, and peel-off, which reduces the effectiveness of such coatings. Some coatings lack commercial or industrial scalability for use in large-scale or high-volume applications.

BRIEF SUMMARY

One embodiment of the present disclosure includes a coated part. The coated part includes a part having a surface. Coating is disposed on the surface of the part. The coating includes at least one sublayer that is disposed on the surface of the part and includes a metal, a ceramic, or a metal-ceramic composite. The at least one sublayer is characterized in that the at least one sublayer has a hardness in excess of 35 HRC. The coating includes at least one top layer that is disposed on a surface of the at least one sublayer, such that the at least one sublayer is positioned between the surface of the part and the at least one top layer. The at least one top layer is characterized in that the at least one top layer includes a polymer. The surface of the at least one sublayer upon which the at least one top layer is disposed has a topography that defines a patterned or roughened surface texture thereof.

Another embodiment of the present disclosure includes an anti-scale deposition coating applied to a part that includes at least one sublayer. The at least one sublayer includes a metal, a ceramic, or a metal-ceramic composite, and is characterized in that the at least one sublayer has a hardness in excess of 35 HRC and has a topography that defines a patterned or roughened surface texture thereof. The anti-scale deposition coating includes at least one top layer disposed on a surface of the at least one sublayer, such that the at least one sublayer is positioned between the surface of the part and the at least one top layer. The at least one top layer is characterized in that the at least one top layer includes a fluoropolymer.

Another embodiment of the present disclosure includes a method of applying a coating onto a surface of a part. The method includes providing a part having a surface, and applying at least one sublayer of a coating onto the surface of the part. The at least one sublayer includes a metal, a ceramic, or a metal-ceramic composite, and is characterized in that the at least one sublayer has a hardness in excess of 35 HRC. The method includes forming a surface texture on a surface of the at least one sublayer. The method includes applying at least one top layer of the coating onto the surface of the at least one sublayer, such that the at least one sublayer is positioned between the at least one top layer and the surface of the part, and characterized in that the at least one top layer includes a polymer. The method includes obtaining a coated part.

BRIEF DESCRIPTION OF THE DRAWINGS

So that the manner in which the features of the compositions, articles, systems and methods of the present disclosure may be understood in more detail, a more particular description briefly summarized above may be had by reference to the embodiments thereof which are illustrated in the appended drawings that form a part of this specification. It is to be noted, however, that the drawings illustrate only various exemplary embodiments and are therefore not to be considered limiting of the disclosed concepts as it may include other effective embodiments as well.

Figure 1B:
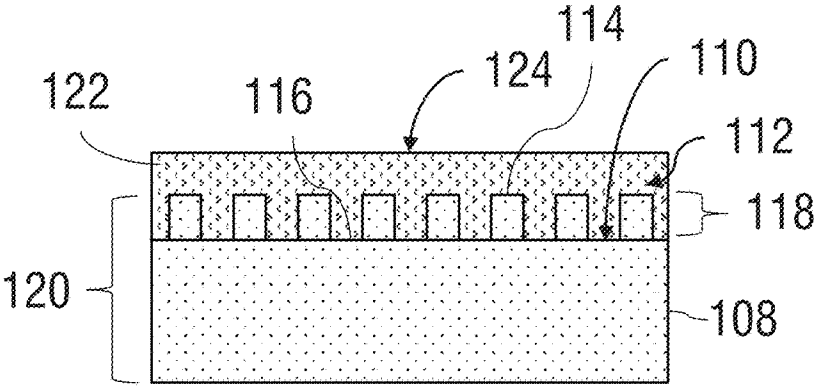
FIG. 1B depicts a coating, showing a surface texture thereof.

Compositions, coatings, articles, systems, and methods according to present disclosure will now be described more fully with reference to the accompanying drawings, which illustrate various exemplary embodiments. Concepts according to the present disclosure may, however, be embodied in many different forms and should not be construed as being limited by the illustrated embodiments set forth herein. Rather, these embodiments are provided so that this disclosure will be thorough as well as complete and will fully convey the scope of the various concepts to those skilled in the art and the best and preferred modes of practice.

DETAILED DESCRIPTION

The present disclosure provides for anti-scale deposition coatings for use in wellbore applications, to apparatus and systems including the same, and to methods of making and using the same. In certain embodiments, the anti-scale deposition coatings disclosed herein are hierarchical coatings, including multiple layers arranged in a selected order.

As used herein, "anti-scale deposition coating" refers to a coating on a surface that retards or eliminates the occurrence of the deposition of scale on the surface, relative to the occurrence of the deposition of scale on an otherwise identical surface without the coating thereon.

Scale is a deposit or coating on a surface of a component, such as a metal component. Some exemplary scales that may be retarded or eliminated by the coatings disclosed herein include, but are not limited to, calcium carbonate, calcium sulfate, barium sulfate, strontium sulfate, iron sulfide, iron oxides, iron carbonate, silicates, phosphates, other oxides, and various other compounds that are insoluble or only slightly soluble in water.

Coating

Certain embodiments of the disclosure include a coating, material composition thereof, apparatus coated therewith, and methods of making, applying, and using the same.

The anti-scale deposition coating, also referred to as the coating, is, in some embodiments, a hierarchical coating. As used herein, a "hierarchical coating" is a coating having at least two layers, with the layers of the coating arranged in a selected order or hierarchy. The layers of the coating may be arranged to provide desired performance properties and characteristics. For example, one layer of the coating may be selected to provide anti-scale deposition properties to the coating and, optionally, low-friction properties to the coating, and may be arranged as a top layer of the coating, and another layer may be selected to provide hardness to the coating, and may be arranged as a sublayer of the coating. As used herein, a "sublayer" is a layer of the coating that is positioned in closer spatial proximity to the underlying surface of the coated part, relative to the spatial position of the top layer. In some such embodiments, the sublayer is positioned directly on the surface of the coated part. As used herein, a "top layer" is a layer of the coating that defines the outer surface of the coated part, and is positioned spatially furthest from the underlying surface of the coated part, relative to other layers of the coating.

In some embodiments, the coating is a "bilayer" coating that has only two layers. In other embodiments, the coating is a "multilayer" coating that has more than two layers. The layers of the coating include at least a first layer and a second layer. In some embodiments, the first layer is a sublayer and the second layer is a top layer. That is, in such embodiments, the top layer is the outermost layer of the coating and the sublayer is the innermost layer of the coating.

In certain embodiments, the anti-scale deposition coating disclosed herein includes a first, sublayer of a metal, ceramic, or metal-ceramic composite, which is characterized in having a hardness in excess of 35 HRC, and a second, top layer over the first, sublayer, wherein the top layer is a polymer. The surface of the at least one sublayer is conditioned to have a roughened or patterned topology for receipt of and adherence with the at least one top layer. The at least one sublayer provides the coating with hardness, and the at least one top layer provides the coating with low-friction and anti-scale properties.

Coating—Sublayer

Figure 1C:
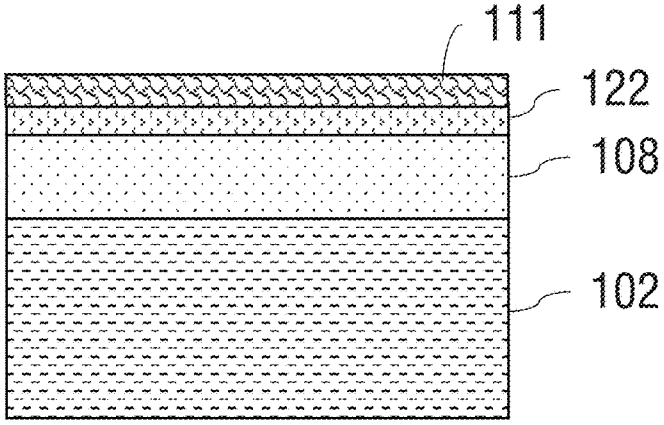
FIG. 1C depicts another embodiment of a coated part.
Figure 1A:
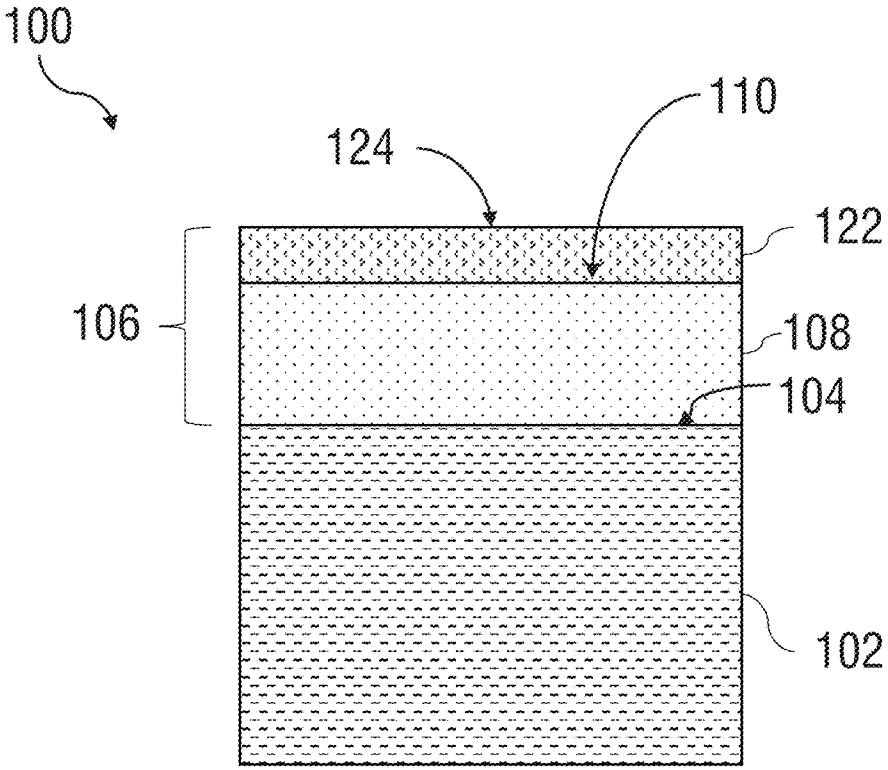
FIG. 1A depicts a coated part.

With reference to FIG. 1A, one exemplary coating will be described. FIG. 1A depicts coated part 100. Coated part 100 includes base substrate 102. Base substrate 102 may be the material that forms a portion of oilfield equipment, for example. In some embodiments, base substrate 102 is composed, at least partially, of a metal alloy or a carbide. For example, base substrate 102 may be composed, at least partially, of carbon steel, low-alloy steel, stainless steel, nickel alloy, cobalt alloy, copper alloy, aluminum alloy, magnesium alloy, or carbide. Base substrate 102 includes surface 104. Surface 104 may be, for example and without limitation, an internal or external surface of an oilfield tool, such as a dynamic sealing area. For example, surface 104 may be a surface of a downhole safety valve, formation isolation valve, flow control valve, packer, plug, downhole tubular, or screen, including for wellhead and coil tubings.

Coating 106 is positioned on outer surface 104. In some embodiments, coating 106 is applied to an entirety of outer surface 104. In other embodiments, coating 106 is applied to less than an entirety of outer surface 104. Coating 106 includes at least two distinct layers. However, while coating 106 in FIG. 1A is shown as including only two distinct layers, at least one sublayer 108 and the at least one top layer 122, the coatings disclosed herein are not limited to including only two layers and may include more than two layers.

At least one sublayer 108 in FIG. 1A, as depicted, forms a sublayer of coating 106 that is positioned below a top, outermost surface of coated part 100 (e.g., top surface 124). The at least one sublayer 108 is applied onto outer surface 104 of base substrate 102. In some embodiments, no other coatings or layers are positioned between the at least one sublayer 108 and outer surface 104. The at least one sublayer 108 may be a single layer construction, or may be a multilayer construction.

In some embodiments, the at least one sublayer 108 is metallic, ceramic or a metal-ceramic composite. For example, the at least one sublayer 108 may be or include a transition metal, such as Nickel, Cobalt, or Chromium; a metal with nitrogen, boron, or carbon, such as $M_xN_y$, $M_xB_y$, or $M_xC_y$, where M designates a metal, N designates Nitrogen, B designates Boron, C designates Carbon, and x and y are integers; a composite of tungsten carbide and a metal alloy; or an oxide-rich coating, such as an oxide of aluminum, an oxide of magnesium, or an oxide of titanium.

The at least one sublayer 108 may have a thickness ranging from 5 μm to 125 μm, or from 10 μm to 120 μm, or from 15 μm to 115 μm, or from 20 μm to 110 μm, or from 25 μm to 105 μm, or from 30 μm to 100 μm, or from 35 μm to 95 μm, or from 40 μm to 90 μm, or from 45 μm to 85 μm, or from 50 μm to 80 μm, or from 55 μm to 75 μm, or from 60 μm to 70 μm, or anywhere therebetween. In other embodiments, the at least one sublayer 108 has a thickness of less than 5 μm, or of greater than 125 μm.

The at least one sublayer 108 may have a hardness of at least 35 HRC, or at least 45 HRC, or at least 50 HRC, or from 35 to 50 HRC, or from 40 to 45 HRC, each as determined in accordance with ASTM E18. In some embodiments, the at least one sublayer 108 has a hardness in excess of 35 HRC, or in excess of 45 HRC, or in excess of 50 HRC, each as determined in accordance with ASTM E18.

Figure 3A:
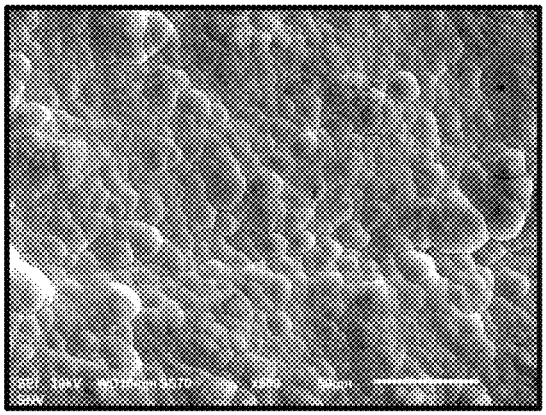
FIG. 3A is an image of as-deposited, electroless nickel plating.
Figure 3B:
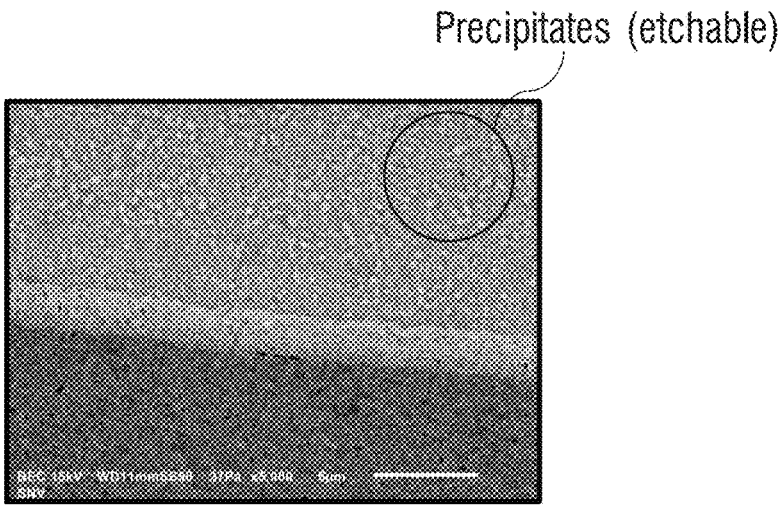
FIG. 3B is an image of electroless nickel plating, where the formation of etchable precipitates is visible, as well as the formation of a supplementary layer with the base substrate.

In an exemplary embodiment, the at least one sublayer 108 is or includes an electrolytically or electroless plated sublayer of coating 106. In some such embodiments a plurality by weight percent or a majority by weight percent of the at least one sublayer 108 is a transition-metal element. The transition metal may be Nickel, Cobalt, or Chromium. Such a sublayer 108 may have an average hardness of at least 35 HRC, as determined in accordance with ASTM E18. Such a coating 106 may have a homogeneous appearance at macroscopic scale, but may include multiple, non-soluble phases at micron scale and during operational conditions of use of coated part 100. That is, in some embodiments, the at least one sublayer 108 has a multiphase bulk morphology, including a continuous matrix phase of metal and a discontinuous distributed phase of, for example, precipitates. The at least one sublayer 108 is chemically etchable to produce a surface topography upon which the at least one top layer 122 may be applied. FIG. 3A is an image of an as-deposited, electroless nickel plating. FIG. 3B is an image of electroless nickel plating, where the formation of etchable precipitates is visible, as well as the formation of a supplementary layer with the base substrate.

In another exemplary embodiment, coating 106 includes a thermally-diffused sublayer as the at least one sublayer 108. Such a sublayer 108 may include metal and nitrogen, boron, or carbon. In such embodiments, the at least one sublayer 108 may be or include a nitride sublayer, a boride sublayer, or a carbide sublayer. For example, the at least one sublayer 108 may be or include $M_xN_y$, $M_xB_y$, or $M_xC_y$, where M designates a metal, N designates Nitrogen, B designates Boron, C designates Carbon, and x and y are integers. For example, and without limitation, the metal, M, may be iron, Fe, such that the at least one sublayer 108 is or includes FeN, or FeB, or $Fe_3C$.

In another exemplary embodiment, coating 106 includes, as the at least one sublayer 108, a sublayer of a composite of tungsten carbide and a metal alloy. The at least one sublayer 108 may be characterized as having a minimum carbide content of 40 wt. %, based on a total weight of the at least one sublayer 108 or, at least, the composite of tungsten carbide and metal alloy may be characterized as having a minimum carbide content of 40 wt. %, based on a total weight of the composite. Such a sublayer 108 may further be characterized as being from 10 μm to 125 μm in thickness and having a minimum Rockwell hardness C of 45.

In another exemplary embodiment, coating 106 includes, as the at least one sublayer 108, a layer of or containing an oxide-rich coating. For example, the oxide-rich coating may be or include an oxide of aluminum, an oxide of magnesium, or an oxide of titanium. Such a sublayer 108 may be characterized as being from 10 μm to 125 μm thick, and having a Rockwell hardness C of at least 45.

Coating—Surface Texture

With reference to FIGS. 1A and 1B, in some embodiments outer surface 110 (i.e., the surface of the at least one sublayer 108 opposite base substrate 102) of the at least one sublayer 108 has patterned or roughened texture thereon, here shown as surface texture 112. Surface texture, also referred to as surface finish or surface topography, may be determined in accordance with ASME Y14.36M standard, for example. As described in more detail below, surface texture 112 may be formed on surface 110 by a surface conditioning process applied to surface 110, which provides surface 110 with a topography that defines surface texture 112. Surface texture 112 may include, for example, peaks 114 and valleys 116. The topography defining surface texture 112 may be from submicron (i.e., less than 1 μm) up to half of a total thickness of the at least one sublayer 108. That is, with reference to FIG. 1B, surface texture thickness 118 (e.g., the height of peaks 114 and depth of valleys 116) may be from submicron to at most equivalent to have of total thickness 120 of the at least one sublayer 108. Surface texture thickness 118 may be, in some embodiments, from 200 nm to 10 microns, or from 150 nm to 5 microns, or from 100 nm to 1 micron. For simplicity, surface texture 112 is shown as a regular, uniform surface texture 112 with each peak 114 and valley 116 being equally spaced and of the same size. However, as would be readily understood by one skilled in the art, surface texture 112 may exhibit variations, including irregular, non-uniform peaks and valleys that are not equally spaced and are of different sizes. In some embodiments, outer surface 110 has a surface texture of from 200 nm to 10 microns, or from 150 nm to 5 microns, or from 100 nm to 1 micron as determined in accordance with ASME Y14.36M standard.

The application of surface texture 112 to the at least one sublayer 108 prepares the at least one sublayer 108 for receipt of and bonding with or adhesion to the at least one top layer 122, which may be the final top layer of coating 106. That is, such surface texture may increase adhesion between the at least one sublayer 108 and the at least one top layer 122. Surface texture 112 may, thus, increase durability of coating 106.

Surface texture 112 may increase chemical repelling abilities of coating 106. That is, coating 106 may exhibit increased non-stick behavior with respect to water and oilfield scales, in comparison to an otherwise identical coating lacking the surface texture. In some embodiments, surface texture 112 may increase the ability of coating 106 to repel water, forming a hydrophobic "water repelling surface". Such a hydrophobic "water repelling surface" may be produced by patterning (applying a pattern) onto surface 110, such as by chemical etching of surface 110. For example, and without limitation, in some applications a combination of hydrogen peroxide and an acid (e.g., hydrochloric acid or nitric acid) may be used to chemically etch the surface to provide hydrophobic properties thereto.

In some embodiments, surface texture 112 may increase the ability of coating 106 to repel oil, forming an oleophobic "oil repelling surface". Such an oleophobic "oil repelling surface" may be produced by patterning (applying a pattern) onto surface 110, such as by anodizing. In some embodiments, after anodizing, surface 110 is coated with fluoroalkyl phosphate, further increasing oleophobic, oil repelling abilities of the coating.

Surface texture 112 may increase functionalization of the at least one sublayer 108; thereby, increasing the occurrence of interlock between the at least one sublayer 108 and a solid or liquid lubricant, which may form a part of the at least one top layer 122.

Surface texture 112 may reduce the drag and friction coefficient of coating, relative to an otherwise identical coating lacking the surface texture. For example, a patterned surface may create turbulence that reduces apparent drag and friction coefficient.

Without being bound by theory, it is believed that surfaces that are more hydrophobic (i.e., create high contact angles) are correspondingly more scale-phobic (i.e., more capable of repelling, retarding or preventing the deposition of scale on the surface). In some embodiments, the coatings disclosed herein are patterned or textured coatings, fluoropolymer coatings (i.e., coatings composed at least partially of fluoropolymer), or combinations thereof; such coatings exhibiting hydrophobicity and scale-phobicity (i.e., lacking affinity to scale).

In some embodiments, coating 106 has a fluoropolymer surface, top surface 124. In some such embodiments, the fluoropolymer top surface is continuous. That is, the at least one top layer 122 is applied to and coated over an entirety of the at least one sublayer 108, such that top surface 124 presents a continuous surface of fluoropolymer coating. Thus, in some embodiments, the at least one top layer 122 is or includes a fluoropolymer. The fluoropolymer of the at least one top layer 122 may be a relatively soft polymer. In some such embodiments, the fluoropolymer is mechanically trapped at surface 110 of the at least one sublayer 108, which may be a relatively hard coating. That is, surface texture 112 may function to mechanically trap the at least one top layer 122 to the at least one sublayer 108. For example, surface texture 112 provides the at least one sublayer 108 with increased surface area at surface 110, such that the surface area of contact between the at least one sublayer 108 and the at least one top layer 122 is increased, relative to an otherwise identical coating lacking the surface texture. Surface texture 112 may thus increase adhesion between the at least one sublayer 108 and the at least one top layer 122, such that, even a relatively soft fluoropolymer may be used as the at least one top layer in relatively harsh downhole environments and operating conditions. In some such embodiments, the at least one top layer 122 may be used in relatively harsh downhole environments and operating conditions with a reduced or eliminated occurrence of bubbling (porosity) in coating 106 (i.e., the formation of gas or void bubbles between the coating and the base substrate), scratching in coating 106 (i.e., the formation of scratches in the coating), and peel-off in coating 106 (i.e., the delamination of the coating from the base substrate), relative to an otherwise identical coating that lacks the surface texture.

Coating—Top Layer

With reference to FIGS. 1A and 1B, coating 106 includes the at least one top layer 122. The at least one top layer 122 may form the outermost layer of coating 106, such that, in use, the at least one top layer 122 is in contact with the surrounding environment (e.g., in contact with fluids within a wellbore). The at least one top layer 122 may be a single layer construction, or may be a multilayer construction.

The at least one top layer 122 is a polymeric coating layer. In some embodiments, the at least one top layer 122 is or includes a non-conductive polymer, such as a non-conductive fluoropolymer. As used herein, a non-conductive polymer refers to a polymer that is not electrically conductive (i.e., is an electrical insulator). In some embodiments, the at least one top layer 122 is or includes a fluoropolymer (e.g., the at least one top layer 122 may be a fluoropolymer topcoat of coating 106). The at least one top layer 122 may be a solid layer, such as a layer composed at least partially of polytetrafluoroethylene (PTFE), perfluoroalkoxy polymer (PFA), ethylene chlorotrifluoroethylene (ECTFE), or fluorinated ethylene propylene (FEP), or a liquid or fluidic layer, such as perfluoropolyether (PFPE), such as a liquid ionic polymer or pore entrapped fluorinated ionic liquid. The at least one top layer 122 may have a thickness of from 5 μm to 25 μm, or from 7 μm to 22 μm, or from 10 μm to 20 μm, or from 12 μm to 18 μm.

In some embodiments, the at least one top layer 122 has a low-friction (e.g., ultralow-friction) top surface 124 that retards or eliminates the deposition of scale thereon (i.e., is an anti-scale deposition coating surface). Without being bound by theory, Applicants have found that at least some embodiments of the coatings disclosed herein offer ultralow friction coefficients under contact pressures that are well in excess of 10,000 psi, and mitigate oilfield scale formations thereon. Furthermore, the coatings disclosed herein exhibit a reduced or eliminated occurrence of peeling failures (i.e., peel-off).

The topography of surface texture 112 may entrap top layer 122 onto sublayer 108. In some embodiments, application of top layer 122 over sublayer 108 fills in the concavities of surface texture 112, such that top layer 122 presents a relatively smooth surface exhibiting lubricity.

In some embodiments, the top surface of coating 106, e.g., top surface 124, is subjected to one or more chemical treatments, is coated with one or more additional coating layers, or combinations thereof. For example, top surface 124 may be: treated an organic acid, such as steric acid; treated with fluoroalkyle silane molecules; coated with Rf-sputtered Teflon; coated with a fluoropolymer film; coated with a stearic acid film; treated with hexadecanoic acid; treated with benzoic acid; or treated with methyltrichlorosilane. FIG. 1C depicts coated article 100, which is otherwise identical to that of FIG. 1A, with the addition of coating layer 111, which may be a Rf-sputtered Teflon; a fluoropolymer film; or a stearic acid film, for example.

Figure 2B:
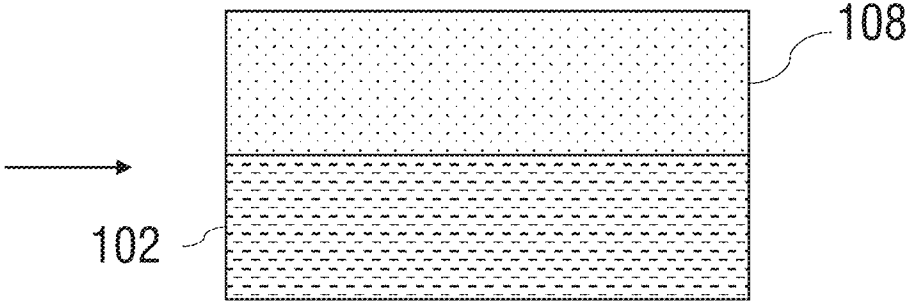
FIG. 2B depicts the part of FIG. 2A with a first sublayer of a coating applied thereto.
Figure 2C:
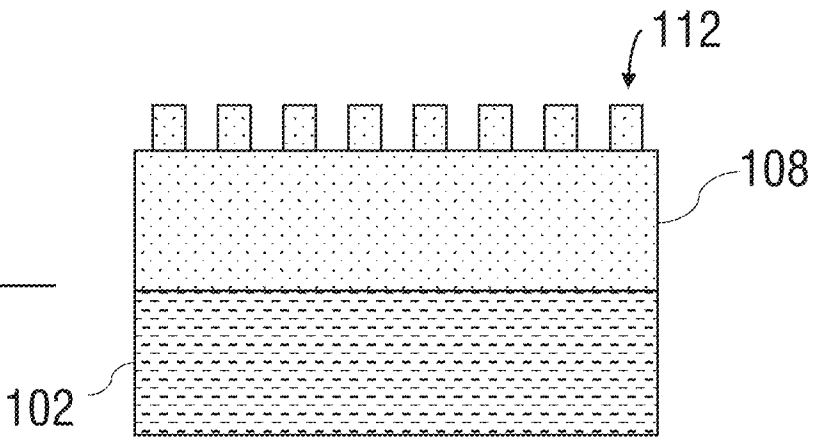
FIG. 2C depicts the part of FIG. 2B, with a surface texture formed on the first sublayer thereof.
Figure 2A:
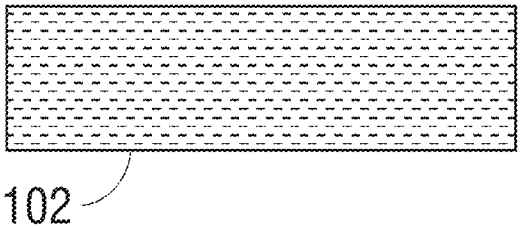
FIG. 2A depicts a part.
Figure 2D:
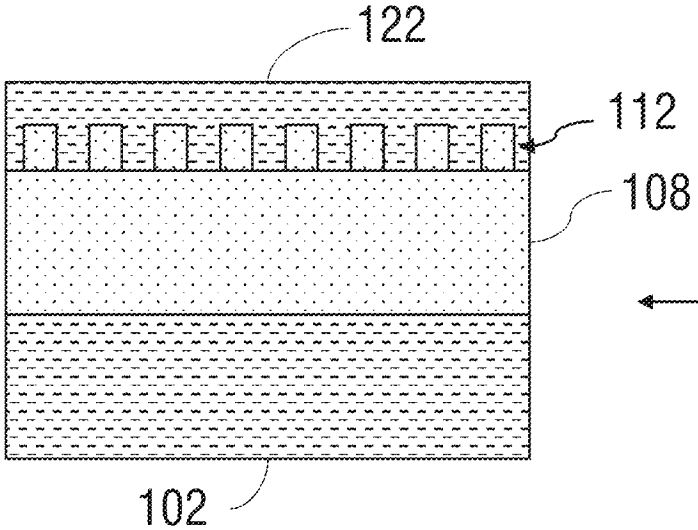
FIG. 2D depicts the part of FIG. 2C with a second, top layer of the coating applied thereto.

FIGS. 2A-2D depict one exemplary sequence for formation of a coated article. Base substrate 102 is provided (FIG. 2A), and is then coated with the at least one sublayer 108 (FIG. 2B). The at least one sublayer 108 may be subjected to processing that imparts surface texture 112 thereto (FIG. 2C), and then the at least one top layer 122 is coated over the at least one sublayer 108 (FIG. 2D).

Figure 6A:
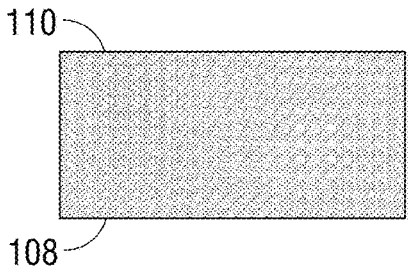
FIG. 6A depicts a first sublayer of the coating.
Figure 6B:
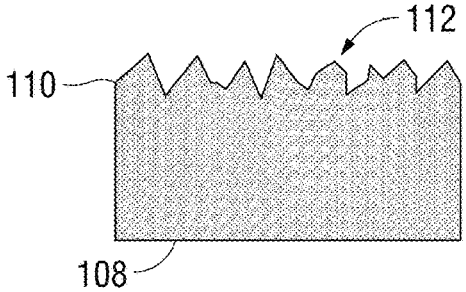
FIG. 6B depicts the first sublayer of FIG. 6A, after a surface conditioning treatment.
Figure 6C:
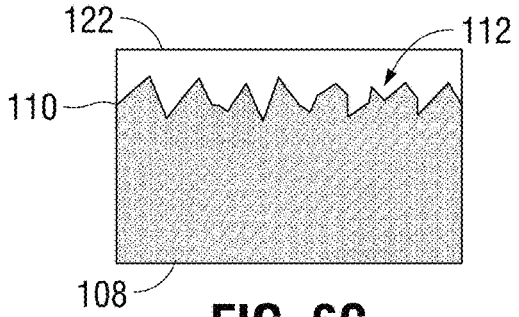
FIG. 6C depicts the first sublayer of FIG. 6B, after applying a second, top layer of the coating thereto.
Figure 6D:
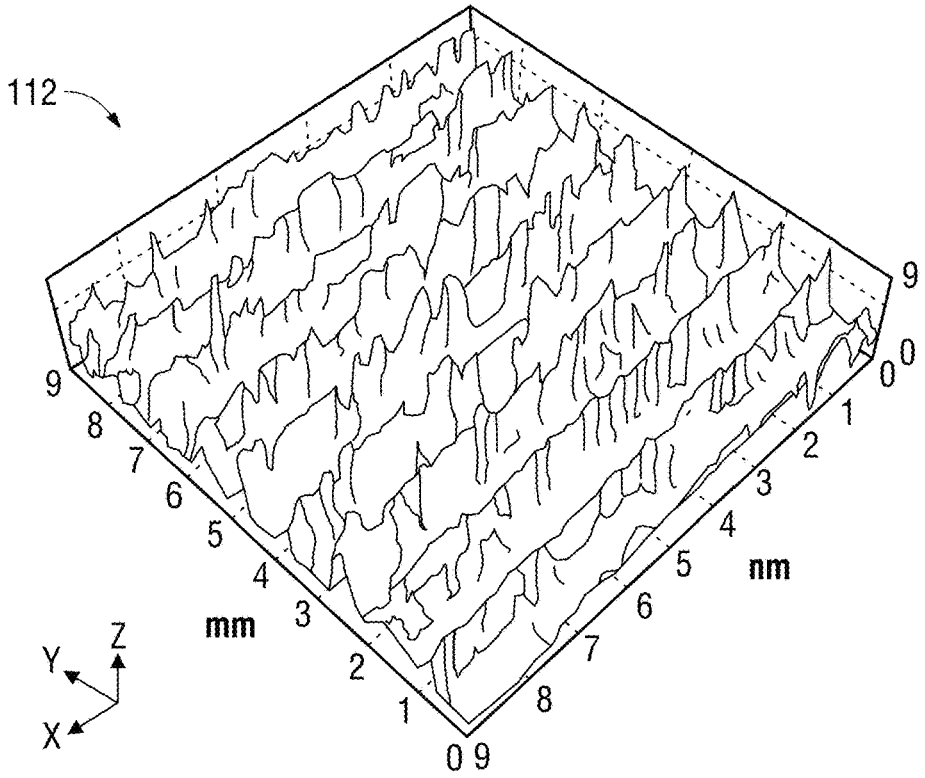
FIG. 6D is a top, perspective view of a conditioned surface having a patterned or roughened surface texture, showing the 3-dimensional nature of the surface texture.

FIGS. 6A-6C depict one exemplary surface conditioning process. For simplicity, the at least one sublayer 108 is shown in isolation from the underlying part (FIG. 6A). The at least one sublayer 108 is subjected to a surface conditioning process, such as etching, to provide the at least one sublayer 108 with surface texture 112 (FIG. 6B). The at least one top layer 122 is then applied on the at least one sublayer 108, over surface texture 112. Surface texture 112 provides increased surface area, relative to the at least one sublayer 108 prior to surface conditioning, such that the at least one sublayer 108 and the at least one top layer 122 have increased contact area for functional engagement and adhesion therebetween. FIG. 6D is a top, perspective view of a conditioned surface having a patterned or roughened surface texture, showing the 3-dimensional nature of the surface texture.

Material Constructions

In some aspects, the present disclosure provides for material constructions, whether applied to an apparatus as a coating or in isolation of an underlying apparatus, including methods of making and using the same. The material constructions may be the same or substantially the same as the coatings shown and described with reference to FIGS. 1A-7.

Coated Part

Figure 7:
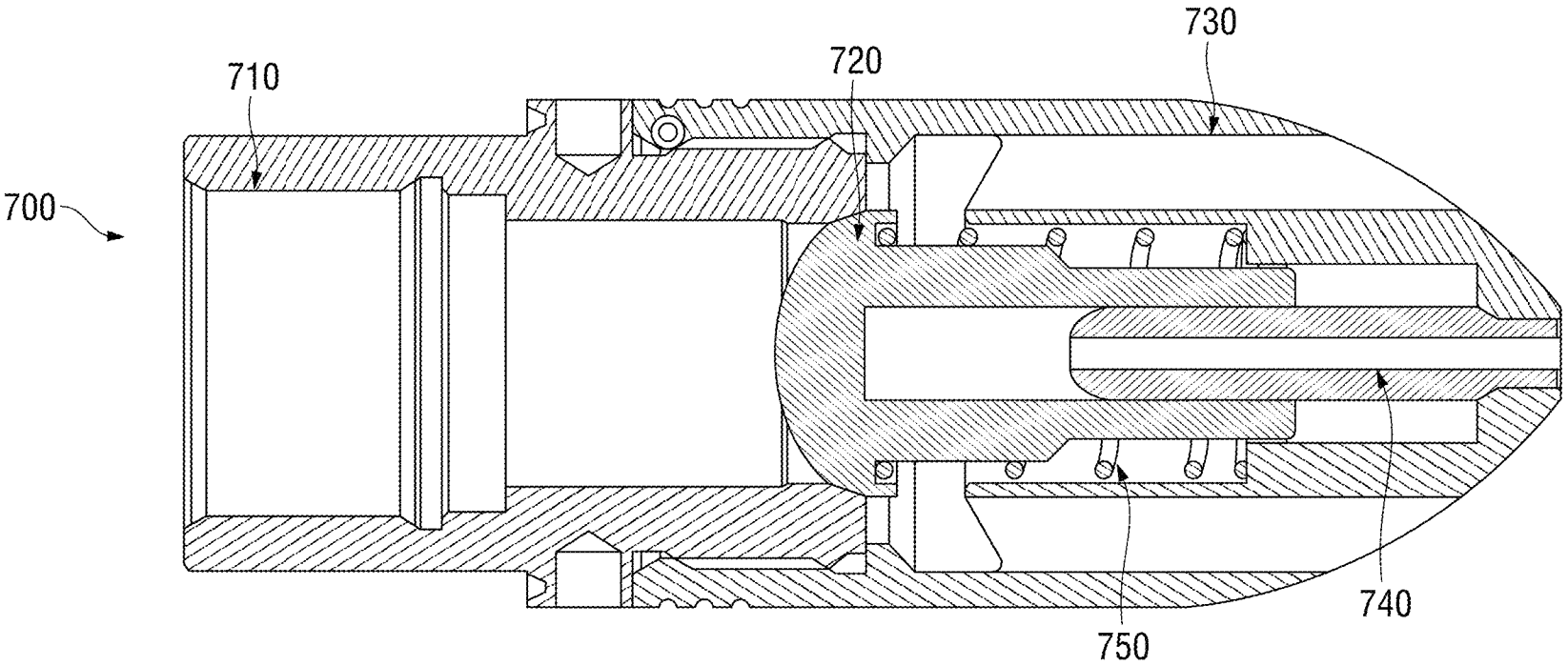
FIG. 7 depicts a gas lift valve, indicating exemplary portions thereof that may be coated with the coating disclosed herein.

Some embodiments include a coated part, including a part and a coating applied to a surface of the part, where the coating is a coating in accordance with the present disclosure. The part may be an oilfield part (i.e., a part used in the drilling and production of oil or gas), including a downhole part (i.e., a part used in a downhole environment). The part may be made at least partially of carbon and low-alloy steels. In some embodiments, the part is at least partially composed of stainless steel, nickel-based alloy, cobalt based alloy, titanium alloy, copper alloy, aluminum alloy, magnesium alloy, or composites thereof. In some aspects, the part is at least partially composed of a composite of a metal alloy and a non-metal material, such as a ceramic or a polymer. The coating disclosed herein may be applied to a cermet (ceramic-metal composite), such as a sintered tungsten carbide. FIG. 7 depicts one exemplary part 700, a gas lift valve, indicating portions thereof that may be coated with a coating in accordance with the present disclosure, including check seat 710 (e.g., a Monel K500 seat), dart 720 (e.g., an Inconel 925 dart), nose 730 (e.g., an Inconel 925 nose), pin 740 (e.g., an Inconel 925 pin), and spring 750 (e.g., an Elgiloy spring).

In some embodiments, the coatings disclosed herein are combined with surface treatments of the underlying surface of the part, such as nitriding.

Method of Applying Coatings to Surfaces

Certain aspects of the present disclosure provide for a method of making a coated part. The method may be used to form a coated part as described with reference to FIGS. 1A-7. The method includes providing a part (e.g., an oilfield part). The part may include one or more surfaces, which may be base substrates upon which the coating may be applied.

The method includes applying at least one sublayer of the coating onto at least one surface of the part. The at least one sublayer of the coating may be applied onto the surface of the part by plating, such as electroless plating or electroplating; thermal spray deposition, such as cold spraying; diffusion coating (e.g., thermal diffusion, including thermochemical diffusion); cladding (e.g., deposition via a melting process); an oxidizing treatment, such as arc oxidation, anodizing, or forced oxidation; or combinations thereof.

After applying the at least one sublayer, the method may, optionally, include forming a texture or pattern on the outer surface of the at least one sublayer, and/or roughening the outer surface of the at least one sublayer using a surface conditioning process on the outer surface of the at least one sublayer. The surface conditioning processes may be a chemical, electrochemical, thermal, and/or photonic surface conditioning treatment, which may prepare the surface of the at least one sublayer for receipt of and adhesion with a fluoropolymer topcoat (i.e., the at least one top layer of the coating). In one exemplary surface conditioning process, the surface of the at least one sublayer is etched to provide the texture, pattern, and/or roughening of the surface of the at least one sublayer. Some exemplary surface conditioning processes include, but are not limited to, chemical etching of the surface of the at least one sublayer; electrochemical etching of the surface of the at least one sublayer; thermal etching of the surface of the at least one sublayer; photonic etching of the surface of the at least one sublayer, such as laser etching and UV etching; plasma etching of the surface of the at least one sublayer; and combinations thereof. Chemical and electrochemical etching may develop relatively fine surface patterns on metal alloys, such as metal alloys traditionally used in oilfield parts. Chemical etching may include etching the surface of the at least one sublayer with an acid, such as HCl or HF. Electrochemical etching may include application of electrical power to the surface of the at least one sublayer. Thermal etching may include burning of a chemical imbedded into the at least one sublayer; e.g., burring of a polymer that is embedded into the at least one sublayer. Photonic etching may include ablation of the surface of the at least one sublayer by electromagnetic radiation, such as by a laser or UV light. Laser etching may provide relatively well-controlled patterns on the surface of the at least one sublayer on microscale level.

Figure 4:
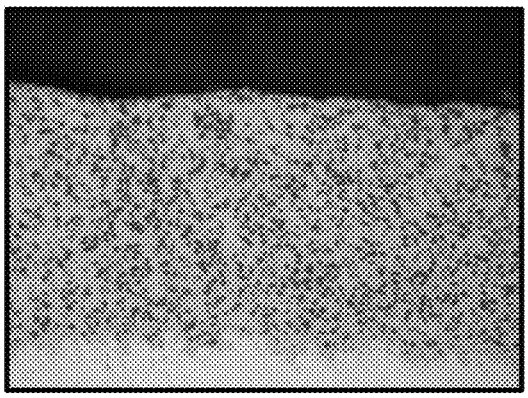
FIG. 4 is an image of SiC reinforced Ni—Co—P electrolytic coating.
Figure 5A:
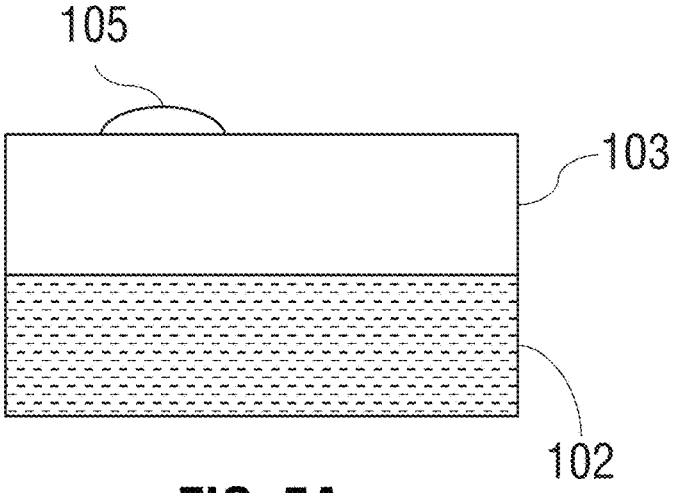
FIG. 5A depicts a plated part with a precipitate thereon.
Figure 5B:
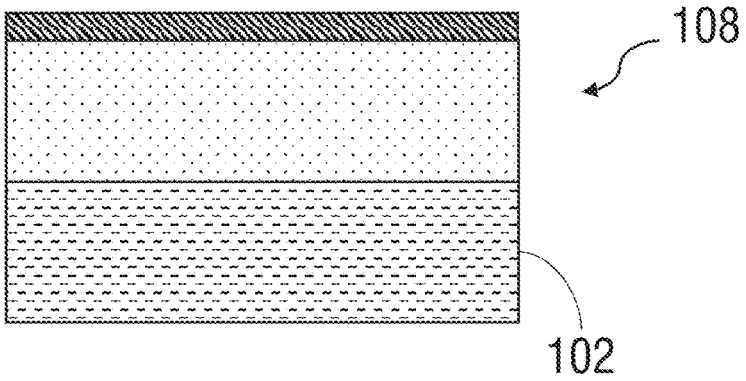
FIG. 5B depicts the plated part of FIG. 5A, hardened after heat-induced nucleation of the precipitate.
Figure 5C:
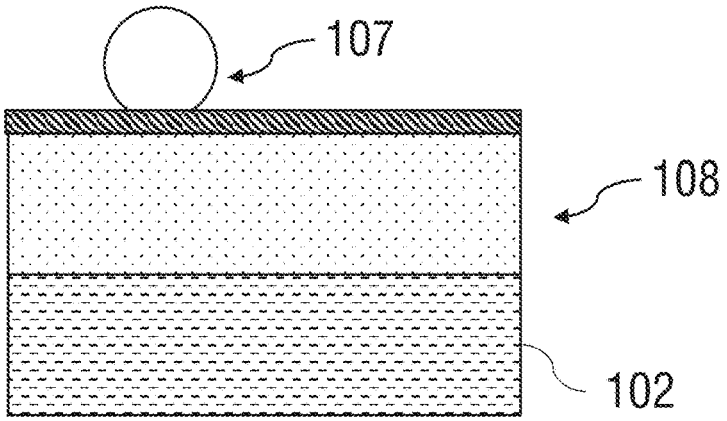
FIG. 5C depicts the plated part of FIG. 5B, modified for increased hydrophobicity.

In one exemplary embodiment, the at least one sublayer is subjected to a surface conditioning or texturing treatment that includes: (1) thermally conditioning the at least one sublayer at temperature in excess of 350° F. That is, the at least one sublayer, after being applied to the part, may be heated to a temperature in excess of 350° F. for a period of time. After the thermal conditioning of the at least one sublayer, the method may then include: (2) chemically etching the surface of the at least one sublayer. In some embodiments, the at least one sublayer may be applied via plating, and the plating may be hardened via heat-induced nucleation of precipitates into the plating. In one example, precipitations of $Ni_3P$, $Ni_3B$, or other nickel-rich compound phases in bulk electroless nickel or electroless nickel plus boron and others may be followed by selective etching of the nickel-rich matrix from the surface of the at least one sublayer. In another example, the at least one sublayer may further include SiC, $SiO_2$, or BN reinforced electroless-nickel plating. In another example, a carbide, such as SiC reinforced Co—Ni—P plating having a hardness of at least 50 HRC, is applied as the at least one sublayer and then etched. With reference to FIG. 4, an image of a SiC reinforced Ni—Co—P electrolytic coating is shown. The coating is rough after deposition and, thus, conducive to texturing treatments. With reference to FIG. 5A, base substrate 102 has plating 103 thereon, with precipitates 105 on plating 103. The structure of FIG. 5A is heated, such that heat-induced nucleation of precipitates 105 occurs, resulting in a hardening of plating 103, forming the at least one sublayer 108 (FIG. 5B), which may be subsequently subjected to texturing with low-surface energy modifiers 107 to provide at the least one sublayer 108 with increased hydrophobicity, and to correspondingly provide the at least one sublayer 108 with increased scale repelling activity (scale-phobicity). Such heat-induced nucleation of precipitates may form a sublayer that has a multiphase bulk morphology, including a continuous matrix phase and a discontinuous, distributed phase.

The method includes applying at least one top layer over the at least one sublayer. In some embodiments, the at least one top layer is applied by depositing a polymer topcoat onto the at least one sublayer. Some exemplary processes that may be used to apply the at least one top layer include, but are not limited to, a spray process, where a high-velocity spray of the material composition of the at least one top layer is sprayed onto the at least one sublayer; and a dip process, where the at least one sublayer (coated onto the part) is dipped into a material composition that forms the at least one top layer.

In one exemplary process, the coating disclosed herein is formed by at least two of the following processes: nitriding or carbonitriding (e.g., via gas, liquid-bath, ion/plasma); liquid-bath boriding; carburizing; electrolytic plating; electroless plating; thermal spraying; high velocity oxygen fuel (HVOF) coating; and laser cladding. In some embodiments, the part or the part as coated with the at least one sublayer may be subjected to nitriding or carbonitriding (e.g., via gas, liquid-bath, ion/plasma); liquid-bath boriding; or carburizing. The at least one sublayer may be applied via electrolytic plating; electroless plating; thermal spraying; high velocity oxygen fuel (HVOF) coating; or laser cladding.

The method may include treating a top surface of the coated part. For example, the top surface of the coated part may be treated with an organic acid such as steric acid, treated with Fluoroalkyle Silane molecules, coated with Rf-sputtered Teflon, coated with fluoropolymer film, coated with Stearic acid film, treated with Hexadecanoic acid, treated with Benzoic acid, or treated with Methyltrichlorosilane.

Some embodiments relate to a method of using a coated part in accordance with the present disclosure. The method includes deploying the coated part into a downhole environment.

Applications

The coatings disclosed herein may be applied to the surfaces of any of various parts. The coatings disclosed herein are particularly suitable for application to surfaces that are deployed downhole and in contact with wellbore fluids from which scale may precipitate.

Exemplary parts on which the presently disclosed coatings may be applied include, but are not limited to, internal and external oilfield tool surfaces, including dynamic sealing areas. Certain exemplary parts or apparatus include downhole safety valves, formation isolation valves, flow control valves, gas lift valves, packers, plugs, downhole tubulars, and screens, including for wellhead and coil tubings. For example, the coating may be applied to adapter check seats, darts, noses, pins, springs, and other components of downhole valves, tubulars, and other tools. The present coatings may be applied to any of various surface of parts used in surface, subsea, and downhole drilling operations, including parts through which corrosive fluids flow or otherwise contact.

While the coatings disclosed herein have been described in reference to use in wellbore and oilfield applications, the coatings may be used in other applications as well, including applications where the coating is used to provide a self-cleaning surface. Thus, in some embodiments, the present disclosure includes a self-cleaning coating or surface, or an apparatus including the same. Some additional exemplary applications of the coatings disclosed herein include the use of the coatings as anti-fouling coatings (i.e., coatings that retard or eliminate the occurrence of fouling on a surface), such as a coating on a marine ship or other marine structure (e.g., a floating oil platform); industrial cleaning applications; coatings on portions of solar panels or solar panel assemblies; and coatings that provide an anti-dirt surface (i.e., a coating that resists the adherence of dirt to a surface).

Embodiments

Certain, non-limiting, embodiments will now be set forth.

Embodiment 1. A coated part including: a part, the part having a surface; at least one sublayer disposed on the surface of the part, the at least one sublayer including a metal, a ceramic, or a metal-ceramic composite, characterized in that the at least one sublayer has a hardness in excess of 35 HRC; and at least one top layer disposed on a surface of the at least one sublayer, such that the at least one sublayer is positioned between the surface of the part and the at least one top layer, characterized in that the at least one top layer includes a polymer.

Embodiment 2. The coated part of embodiment 1, wherein the at least one sublayer includes plating including a transition-metal; a thermally-diffused layer including a metal and N, B, or C; a composite of tungsten carbide and a metal alloy; or a metal oxide.

Embodiment 3. The coated part of embodiment 2, wherein the at least one sublayer includes electrolytically plating or electroless plating, the plating including Nickel, Cobalt, or Chromium.

Embodiment 4. The coated part of embodiment 2, wherein the at least one sublayer is a thermally-diffused layer including $M_xN_y$, $M_xB_y$, or $M_xC_y$, wherein M is a metal, N is nitrogen, B is boron, C is carbon, and x and y are integers.

Embodiment 5. The coated part of embodiment 2, wherein the at least one sublayer includes a composite of tungsten carbide and a metal alloy, the at least one sublayer characterized as including at least 40 wt. % of carbide based on a total weight of the at least one sublayer, having a thickness of from 10 μm to 125 μm, and having a minimum Rockwell hardness C of 45.

Embodiment 6. The coated part of claim 2, wherein the at least one sublayer includes an oxide of aluminum, an oxide of magnesium, or an oxide of titanium, the at least one sublayer characterized as having a thickness of from 10 μm to 125 μm and having a minimum Rockwell hardness C of 45.

Embodiment 7. The coated part of any of embodiments 1 to 6, wherein the at least one sublayer has a thickness ranging from 5 μm to 125 μm.

Embodiment 8. The coated part of any of embodiments 1 to 7, wherein the surface of the at least one sublayer upon which the at least one top layer is disposed has a patterned or roughened topography that defines a surface texture, the topography being from submicron up to half of a total thickness of the at least one sublayer.

Embodiment 9. The coated part of embodiment 8, wherein the surface of the at least one sublayer upon which the at least one top layer is disposed is an etched surface.

Embodiment 10. The coated part of embodiment 9, wherein the surface of the at least one sublayer upon which the at least one top layer is disposed is a chemically etched surface, an electrochemically etched surface, a thermally etched surface, a photonically etched surface, or a plasma etched surface.

Embodiment 11. The coated part of embodiment 9, wherein the at least one sublayer includes $Ni_3P$ and/or $Ni_3B$ precipitated in bulk electroless nickel plating; SiC, $SiO_2$, or BN reinforced electroless-nickel plating; or carbide reinforced plating having a hardness of at least 50 HRC.

Embodiment 12. The coated part of any of embodiments 1 to 11, wherein the at least one top layer includes a non-conductive polymer.

Embodiment 13. The coated part of any of embodiments 1 to 12, wherein the at least one top layer includes a fluoropolymer.

Embodiment 14. The coated part of embodiment 13, wherein the at least one top layer includes polytetrafluoroethylene (PTFE), perfluoroalkoxy polymer (PFA), ethylene chlorotrifluoroethylene (ECTFE), fluorinated ethylene propylene (FEP), or perfluoropolyether (PFPE).

Embodiment 15. The coated part of any of embodiments 1 to 14, wherein the at least one top layer is a solid layer.

Embodiment 16. The coated part of any of embodiments 1 to 14, wherein the at least one top layer is a liquid or fluidic layer.

Embodiment 17. The coated part of embodiment 16, wherein the at least one top layer includes a liquid ionic polymer.

Embodiment 18. The coated part of embodiment 16, wherein the at least one top layer includes a pore entrapped fluorinated ionic liquid.

Embodiment 19. The coated part of any of embodiments 1 to 18, wherein a surface of the at least one top layer, opposite the at least one sublayer, is: treated with an organic acid; treated with fluoroalkyle silane molecules; coated with Rf-sputtered Teflon; coated with a fluoropolymer film; coated with a stearic acid film; treated with hexadecanoic acid; treated with benzoic acid; or treated with methyltrichlorosilane.

Embodiment 20. The coated part of any of embodiments 1 to 19, wherein the surface of the part includes a metal alloy, a carbide, a composite of a metal alloy and a ceramic, or a composite of a metal alloy and a polymer.

Embodiment 21. The coated part of any of embodiments 1 to 20, wherein the surface of the part includes carbon steel, low-alloy steel, stainless steel, nickel alloy, cobalt alloy, copper alloy, aluminum alloy, magnesium alloy, or carbide.

Embodiment 22. The coated part of any of embodiments 1 to 21, wherein the part is an oilfield part, and wherein the coating is an anti-scale deposition coating on the oilfield part, the anti-scale deposition coating characterized in that it retards the occurrence of deposition of scale on the surface of the part, relative to the occurrence of the deposition of scale on an otherwise identical part without the coating thereon.

Embodiment 23. The coated part of any of embodiments 1 to 21, wherein the part is a marine structure, and wherein the coating is an anti-fouling coating on the marine structure, the anti-fouling coating characterized in that it retards the occurrence of fouling on the surface of the part, relative to the occurrence of the fouling on an otherwise identical part without the coating thereon.

Embodiment 24. The coated part of any of embodiments 1 to 21, wherein the part is a downhole safety valve, a formation isolation valve, a flow control valve, a gas lift valve, a packer, a plug, a downhole tubular, a screen, or a solar panel.

Embodiment 25. The coated part of any of embodiments 1 to 24, wherein the coating is hydrophobic, oleophobic, or combinations thereof.

Embodiment 26. An anti-scale deposition coated part including: a part, the part having a surface; and an anti-scale deposition coating on the surface of the part, the anti-scale deposition coating including: at least one sublayer disposed on the surface of the part, the at least one sublayer including a metal, a ceramic, or a metal-ceramic composite, characterized in that the at least one sublayer has a hardness in excess of 35 HRC, a thickness of from 5 to 75 μm, and a topography that defines a patterned or roughened surface texture thereof; and at least one top layer disposed on a surface of the at least one sublayer, such that the at least one sublayer is positioned between the surface of the part and the at least one top layer, characterized in that the at least one top layer includes a fluoropolymer.

Embodiment 27. A method of applying a coating onto a surface of a part, the method including: providing a part, the part including a surface; applying at least one sublayer of a coating onto the surface of the part, the at least one sublayer including a metal, a ceramic, or a metal-ceramic composite, characterized in that the at least one sublayer has a hardness in excess of 35 HRC; and applying at least one top layer of the coating onto a surface of the at least one sublayer, such that the at least one sublayer is positioned between the at least one top layer and the surface of the part, characterized in that the at least one top layer includes a polymer; and obtaining a coated part.

Embodiment 28. The method of claim 27, wherein the at least one sublayer of the coating is applied onto the surface of the part by plating, thermal spray deposition, diffusion coating, cladding, an oxidizing treatment, or combinations thereof.

Embodiment 29. The method of embodiment 28, wherein the at least one sublayer of the coating is applied onto the surface of the part by electroless plating or electroplating; cold spraying; thermal diffusion coating or thermo-chemical diffusion coating; arc oxidation, anodizing, or forced oxidation; or combinations thereof.

Embodiment 30. The method of any of embodiments 27 to 29, wherein the at least one top layer is applied onto the surface of the at least one sublayer by spraying or dipping.

Embodiment 31. The method of any of embodiments 27 to 30, further including, after applying the at least one sublayer and before applying the at least one top layer, forming a surface texture on the surface of the at least one sublayer.

Embodiment 32. The method of embodiment 31, wherein forming the surface texture includes etching the surface.

Embodiment 33. The method of embodiment 32, wherein etching the surface includes chemically etching the surface, electrochemically etching the surface, thermally etching the surface, photonically etching the surface, plasma etching the surface, or combinations thereof.

Embodiment 34. The method of embodiment 31, wherein forming the surface texture includes thermally conditioning the at least one sublayer at temperature in excess of 350° F., and then chemically etching the surface of the at least one sublayer.

Embodiment 35. The method of embodiment 32, wherein the at least one sublayer is applied onto the base substrate via plating, and wherein the plating is hardened via heat-induced nucleation of precipitates into the plating.

Embodiment 36. The method of any of embodiments 27 to 35, wherein applying the coating onto the surface of the part includes at least two of the following processes: nitriding or carbonitriding; liquid-bath boriding; carburizing; electrolytic plating; electroless plating; thermal spraying; high velocity oxygen fuel coating; and laser cladding.

Embodiment 37. The method of any of embodiments 27 to 36, further including treating a top surface of the coating with an organic acid, treating the top surface of the coating with Fluoroalkyle Silane molecules, coating the top surface of the coating with Rf-sputtered Teflon, coating the top surface of the coating with a fluoropolymer film, coating the top surface of the coating with a Stearic acid film, treating the top surface of the coating with Hexadecanoic acid, treating the top surface of the coating with Benzoic acid, or treating the top surface of the coating with Methyltrichlorosilane.

Embodiment 38. A method of using a coated part, the method including: providing a coated part, the coated part including: a part, the part having a surface; at least one sublayer disposed on the surface of the part, the at least one sublayer including a metal, a ceramic, or a metal-ceramic composite, characterized in that the at least one sublayer has a hardness in excess of 35 HRC; and at least one top layer disposed on a surface of the at least one sublayer, such that the at least one sublayer is positioned between the part and the at least one top layer, characterized in that the at least one top layer includes a polymer; and deploying the coated part into a downhole environment.

Although the present embodiments and advantages have been described in detail, it should be understood that various changes, substitutions and alterations can be made herein without departing from the spirit and scope of the disclosure. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A coated part exposed to wellbore production fluids, the coated part comprising:

a part, the part having a surface; and a coating disposed on the part, the coating comprising:

at least one sublayer disposed on the surface of the part, the at least one sublayer comprising a metal, a ceramic, or a metal-ceramic composite, wherein the at least one sublayer has a hardness in excess of 35 HRC, and wherein: the at least one sublayer comprises a plating comprising Nickel, Cobalt, or Chromium, and wherein the at least one sublayer includes $SiO_2$ reinforced electroless-nickel plating; and at least one top layer disposed on a surface of the at least one sublayer, such that the at least one sublayer is positioned between the surface of the part and the at least one top layer, wherein the at least one top layer comprises a polymer, wherein the surface of the at least one sublayer upon which the at least one top layer is disposed has a topography that defines a patterned or roughened surface texture thereof, wherein the surface of the at least one sublayer upon which the at least one top layer is disposed is an etched surface, and wherein a surface of the at least one top layer, opposite the at least one sublayer, is treated with an organic acid; treated with fluoroalkyl silane molecules; or treated with methyltrichlorosilane.

2. The coated part of claim 1, wherein the at least one top layer is applied to and coated over an entirety of the at least one sublayer, and wherein the at least one top layer consists essentially of a fluoropolymer.

3. An anti-scale deposition coating applied to a part, the anti-scale deposition coating comprising:

at least one sublayer comprising a metal, a ceramic, or a metal-ceramic composite, wherein the at least one sublayer has a hardness in excess of 35 HRC, and a surface that has a topography that defines a patterned or roughened surface texture thereof, and wherein: the at least one sublayer comprises a plating comprising Nickel, Cobalt, or Chromium, and wherein the at least one sublayer includes SiO2 reinforced electroless-nickel plating; and at least one top layer disposed on the surface of the at least one sublayer, wherein the at least one top layer comprises a fluoropolymer, wherein the surface of the at least one sublayer upon which the at least one top layer is disposed is an etched surface, and wherein a surface of the at least one top layer, opposite the at least one sublayer, is treated with an organic acid; treated with fluoroalkyl silane molecules; or treated with methyltrichlorosilane.

4. A coated part exposed to wellbore production fluids, the coated part comprising:

a part, the part having a surface; and a coating disposed on the part, the coating comprising:

at least one sublayer disposed on the surface of the part, the at least one sublayer comprising a metal, a ceramic, or a metal-ceramic composite, wherein the at least one sublayer has a hardness in excess of 35 HRC, and wherein:

the at least one sublayer comprises a plating comprising Nickel, Cobalt, or Chromium deposited by an electrolytic plating process or an electroless plating process; or the at least one sublayer comprises a thermally-diffused layer comprising $M_xN_y$, $M_xB_y$, or $M_xC_y$, wherein M is a metal, N is nitrogen, B is boron, C is carbon, and x and y are integers; or the at least one sublayer comprises a composite of tungsten carbide and a metal alloy, where the at least one sublayer comprises at least 40 wt % of carbide based on a total weight of the at least one sublayer, has a thickness of from 10 μm to 125 μm, and has a minimum Rockwell hardness C of 45; or the at least one sublayer comprises an oxide of aluminum, an oxide of magnesium, or an oxide of titanium, wherein the at least one sublayer has a thickness of from 10 μm to 125 μm and having a minimum Rockwell hardness C of 45; and at least one top layer disposed on a surface of the at least one sublayer, such that the at least one sublayer is positioned between the surface of the part and the at least one top layer, wherein the at least one top layer comprises a polymer, wherein a surface of the at least one top layer, opposite the at least one sublayer, is treated with an organic acid; treated with fluoroalkyl silane molecules; or treated with methyltrichlorosilane, and wherein the surface of the at least one sublayer upon which the at least one top layer is disposed has a topography that defines a patterned or roughened surface texture thereof, and wherein the at least one top layer comprises a liquid ionic polymer or a pore entrapped fluorinated ionic liquid.

5. The coated part of claim 4, wherein the at least one top layer is applied to and coated over an entirety of the at least one sublayer, and wherein the at least one top layer consists essentially of a fluoropolymer.

6. The coated part of claim 4, wherein the at least one top layer is a solid top layer consisting essentially of polytetrafluoroethylene (PTFE), perfluoroalkoxy polymer (PFA), ethylene chlorotrifluoroethylene (ECTFE), or fluorinated ethylene propylene (FEP); or wherein the at least one top layer is a fluidic top layer consisting essentially of perfluoropolyether (PFPE).

7. The coated part of claim 4, wherein the surface of the at least one top layer, opposite the at least one sublayer, is treated with the organic acid, and wherein the organic acid comprises stearic acid, hexadecanoic acid, or benzoic acid.

8. The coated part of claim 4, wherein the at least one top layer consists essentially of a fluoropolymer and has a thickness of 5 μm to 25 μm.

9. The coated part of claim 4, wherein the at least one top layer is applied to and coated over an entirety of the at least one sublayer, and wherein the at least one top layer consists essentially of a fluoropolymer and has a thickness of 5 μm to 25 μm.

10. The coated part of claim 4, wherein the surface of the at least one top layer, opposite the at least one sublayer, is treated with the organic acid, and wherein the organic acid comprises hexadecanoic acid or benzoic acid.

11. The coated part of claim 4, wherein the surface of the at least one top layer, opposite the at least one sublayer, is treated with fluoroalkyl silane molecules.

12. The coated part of claim 4, wherein the surface of the at least one top layer, opposite the at least one sublayer, is treated with methyltrichlorosilane.

13. The coated part of claim 4, wherein:

the at least one sublayer comprises the plating comprising Nickel, Cobalt, or Chromium, the at least one sublayer includes $SiO_2$ reinforced electroless-nickel plating, the at least one top layer consists essentially of a fluoropolymer and has a thickness of 5 μm to 25 μm, and the surface of the at least one top layer, opposite the at least one sublayer, is treated with fluoroalkyl silane molecules or methyltrichlorosilane.

* * * * *